US007674150B2

(12) United States Patent
Hippely

(10) Patent No.: US 7,674,150 B2
(45) Date of Patent: Mar. 9, 2010

(54) TOY WITH TETHERED PIECES

(75) Inventor: Keith Hippely, Manhattan Beach, CA (US)

(73) Assignee: Mattel, Inc., El Segundo, CA (US)

( * ) Notice: Subject to any disclaimer, the term of this patent is extended or adjusted under 35 U.S.C. 154(b) by 431 days.

(21) Appl. No.: 11/418,680

(22) Filed: May 4, 2006

(65) Prior Publication Data

US 2007/0259590 A1 Nov. 8, 2007

(51) Int. Cl.
*A63H 17/02* (2006.01)

(52) U.S. Cl. ..... 446/6; 446/470

(58) Field of Classification Search ..... 446/308, 446/309, 310, 311, 4, 6, 435, 465, 470
See application file for complete search history.

(56) References Cited

U.S. PATENT DOCUMENTS 233,166 A * 10/1880 Rose ..... 446/310
341,329 A * 5/1886 Harden et al. ..... 446/6
2,303,652 A * 12/1942 McGaugh et al. ..... 446/310
2,385,724 A * 9/1945 Olson ..... 273/380
2,449,116 A * 9/1948 Hatchett ..... 434/176
2,597,094 A * 5/1952 Gutmann ..... 446/6
2,757,482 A 8/1956 Brown et al.
2,803,920 A 8/1957 Salosky
3,037,772 A 6/1962 Bonanno
3,176,429 A 4/1965 Brown et al.
3,959,920 A 6/1976 Ieda
4,248,006 A 2/1981 Jones et al.
4,307,533 A 12/1981 Sims et al.
4,568,307 A 2/1986 Gabler et al.
4,578,046 A 3/1986 Ohno
4,580,993 A 4/1986 Ohno
4,586,911 A 5/1986 Marakami
4,588,386 A * 5/1986 Kennedy et al. ..... 446/6
4,717,367 A 1/1988 Stubenfoll et al.
4,762,511 A * 8/1988 Lee et al. ..... 446/6
4,911,669 A 3/1990 Parker
5,267,888 A 12/1993 Hippely et al.
5,292,275 A 3/1994 Swisher et al.
5,310,379 A 5/1994 Hippely et al.

(Continued)

FOREIGN PATENT DOCUMENTS

DE 29724498 U1 5/1999

(Continued)

OTHER PUBLICATIONS

Product Information document with three photographs, 2 pages, relating to product on sale prior to May 2005.

*Primary Examiner*—John Ricci
(74) *Attorney, Agent, or Firm*—Edell, Shapiro & Finnan LLC

(57) ABSTRACT

A toy. The toy includes a body and a plurality of tethers moveably coupled to the body. The toy also includes a corresponding plurality of tethered pieces coupled to the plurality of tethers and moveable between a retracted state in which the plurality of tethers hold the tethered pieces proximate the body and an extended state in which the plurality of tethers hold the tethered pieces away from the body. A triggering mechanism operatively is adapted to move the plurality of tethered pieces from the retracted state to the extended state responsive to a triggering event.

25 Claims, 8 Drawing Sheets

U.S. PATENT DOCUMENTS

| | | | |
|---|---|---|---|
| 5,334,078 | A | 8/1994 | Hippely et al. |
| 5,372,534 | A | 12/1994 | Levy et al. |
| 5,380,231 | A | 1/1995 | Brovelli |
| 5,474,486 | A | 12/1995 | Chilton et al. |
| 5,626,506 | A | 5/1997 | Halford et al. |
| 5,906,528 | A | 5/1999 | Ostendorff et al. |
| 6,152,801 | A | 11/2000 | Tsai |
| 6,749,482 | B1 | 6/2004 | Hollis et al. |

FOREIGN PATENT DOCUMENTS

| | | | |
|---|---|---|---|
| JP | 07163761 | A | 6/1995 |
| WO | WO 96/29268 | A1 | 9/1996 |

* cited by examiner

TOY WITH TETHERED PIECES

BACKGROUND

Some children enjoy playing with toys that can be unassembled and reassembled. In particular, toys that feature an automatic disassembly that mimics a crash or explosion can be very popular. The simulated chaos of a crash or an explosion can add an element of excitement to play.

SUMMARY

The inventor has recognized that toys that can be unassembled often include many separate parts that are easy to lose. Furthermore, the explosion mode can be short-lived, only providing a moment of visual stimulation. Accordingly, a toy that includes a plurality of pieces that can extend away from the toy in a crash or explosion mode is provided. The pieces can be tethered to the toy, and at least some of the pieces can remain at least partially suspended off the ground by the tethers after extending away from the body of the toy. The tethers can be made from an at least partially resilient material that allows the pieces to continue to move after a simulated crash or explosion is completed. The plurality of pieces can be reset by a common mechanism so that each individual piece does not have to be separately put back together. The tethered pieces can be keyed to the body to facilitate the return of the keyed pieces to substantially the same location every time the pieces are moved back to a retracted state.

WRITTEN DESCRIPTION

The present disclosure is directed to a toy that includes one or more pieces that are separable from the core of the toy, but which remain connected to the core of the toy via corresponding tethers. As explained herein, a sudden transition from the retracted state to the extended state can create an interesting visual effect, simulating a crash, explosion, or other dramatic disassembly. The tethers can hold the tethered pieces away from the toy and/or above the ground, enhancing the visual effect. Pieces held by long tethers can be extended further away from the body, generating the impression that the pieces are separate from the body. This visual effect can be further amplified when the tethers are configured to twist or arc the pieces as they extend, and/or when the tethers are configured to allow the extended tethered pieces to oscillate, vibrate, or wiggle. Furthermore, the extended pieces can be easily reset to the retracted state. While the present disclosure describes an exemplary toy vehicle, it should be understood that the herein described concepts can be applied equally well to a variety of different toys. For example, tethers could be used to extend the eyes, teeth, and/or other parts of a toy monster. These and other features are explained below by way of nonlimiting example.

Figure 1:
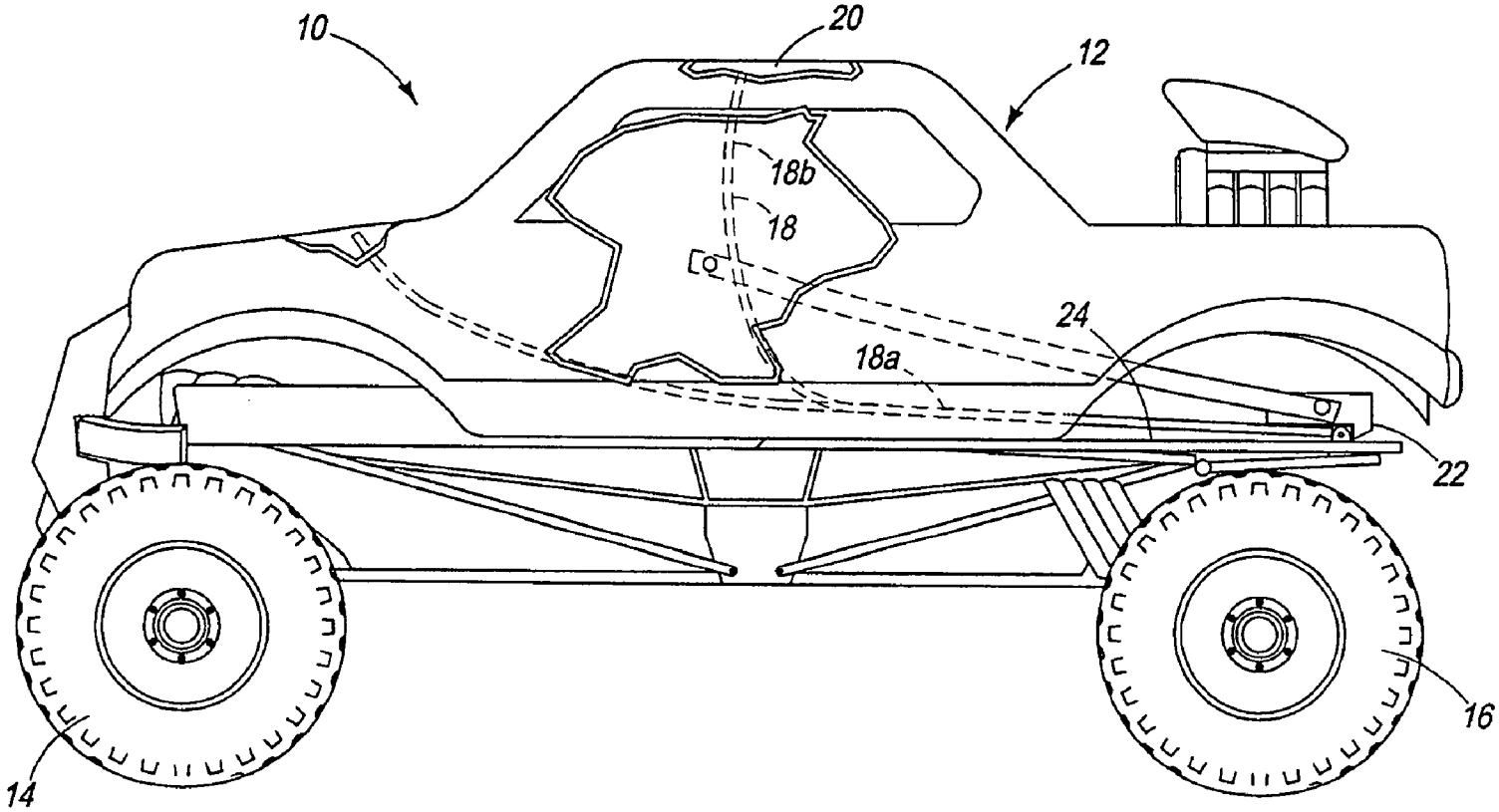
FIG. 1 shows an exemplary toy with tethered pieces in a retracted state.
Figures 2, 2A:
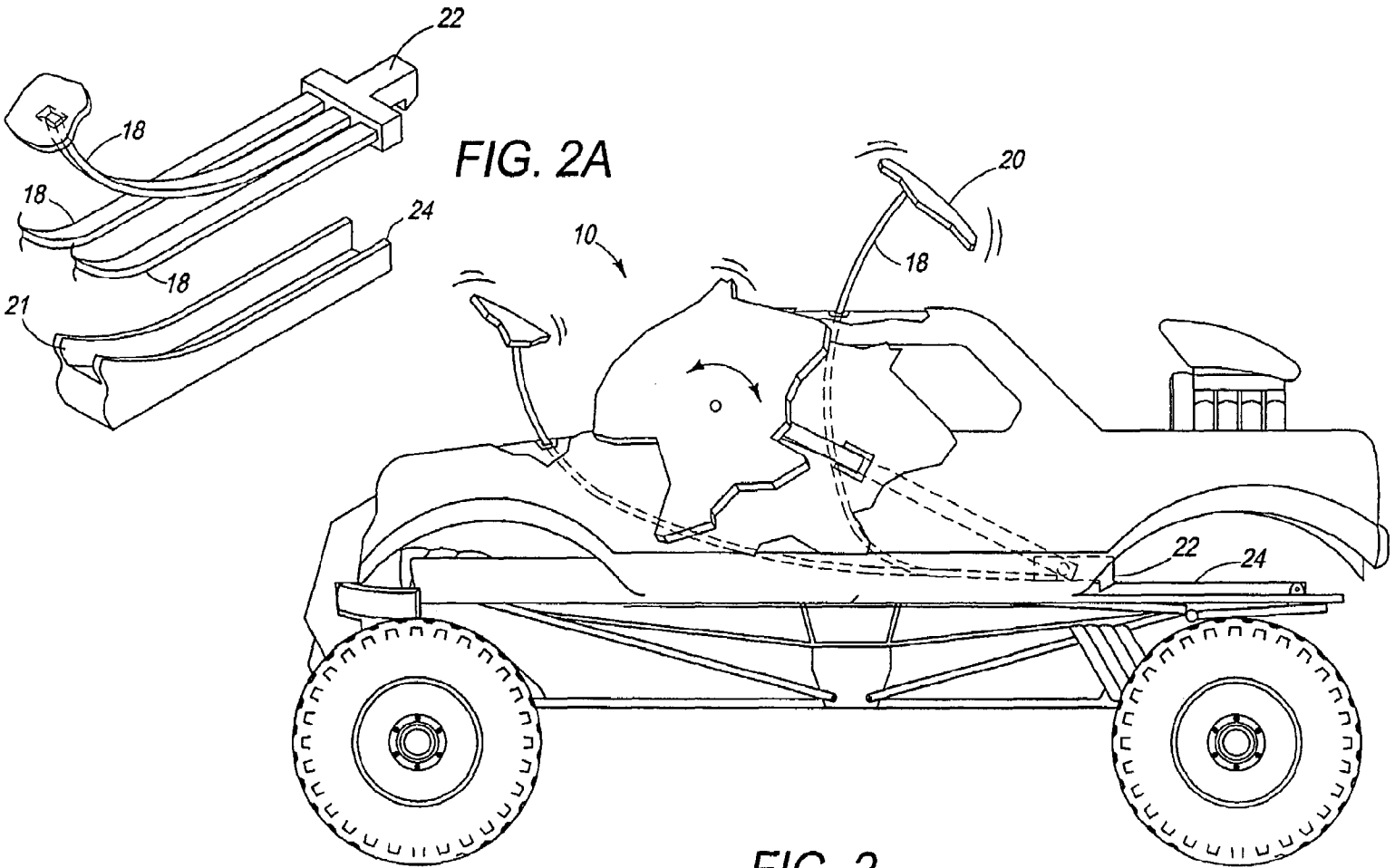
FIG. 2 shows the toy of FIG. 1 with the tethered pieces in an extended state.
FIG. 2A schematically shows a portion of the tethering assembly of the toy of FIG. 1.
Figure 3:
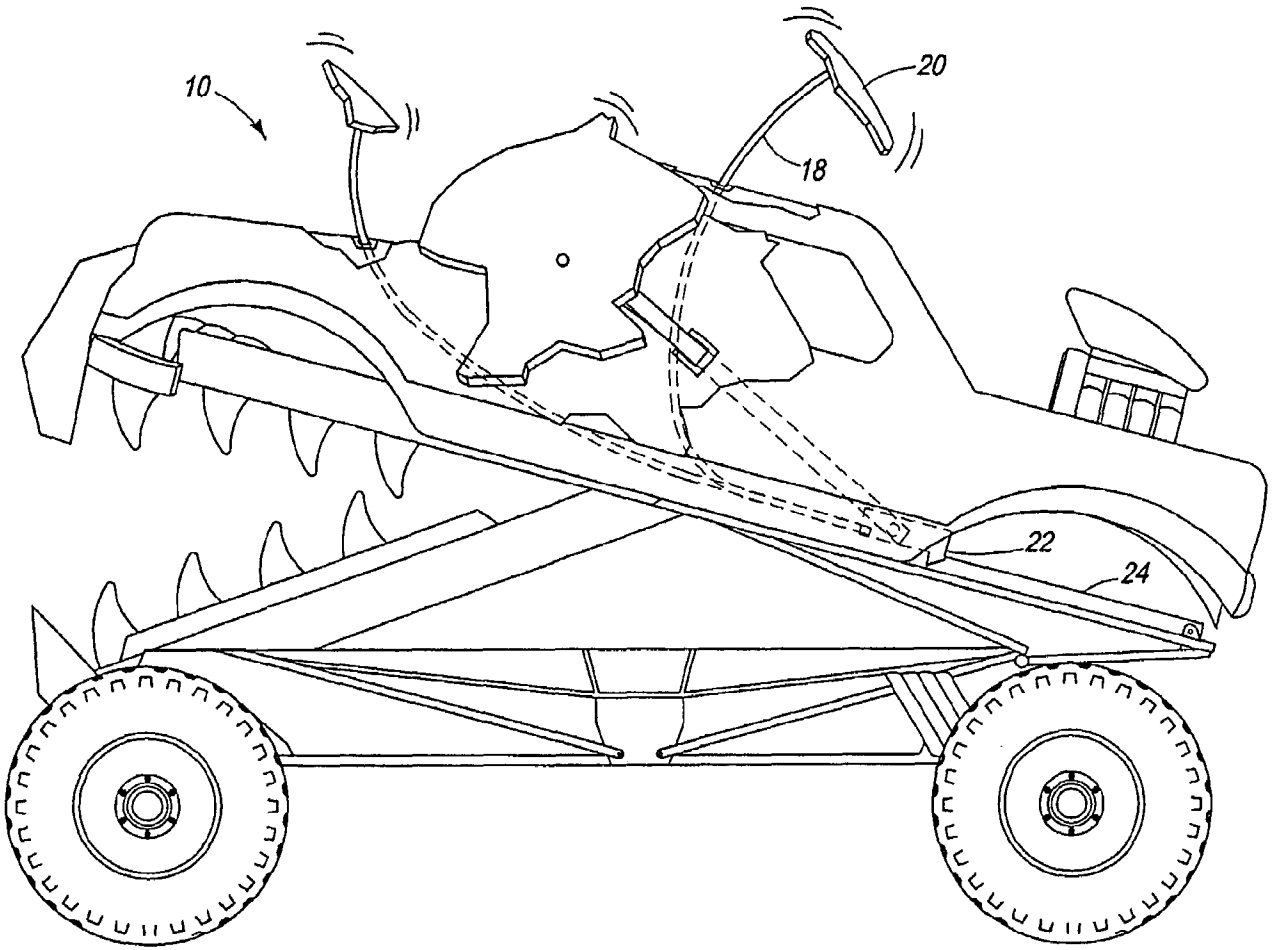
FIG. 3 shows the toy of FIG. 1 with the tethered pieces in an extended state and with an open-mouth configuration.

FIG. 1 shows an exemplary toy 10 with tethered pieces in a retracted state, and FIG. 2 shows the same toy with the tethered pieces in an extended state. FIG. 3 shows the same toy in an open-mouth configuration. While open-mouth functionality can be combined with the tethered pieces, this is not required in all embodiments.

In the illustrated embodiment, the toy is a car, although this is not required. Car 10 includes a body 12, front wheels 14, back wheels 16, tethers 18, and tethered pieces 20. As can be seen in dashed lines, the tethers can be at least partially enclosed within body 12 when in the retracted state. Accordingly, the tethering mechanism can be at least partially hidden so that it is not obvious that the toy is configured differently than most other toys.

The length of a tether affects the distance the pieces can be extended away from body. Longer tethers can extend pieces farther than shorter tethers. As shown in FIGS. 1 and 2, at least some of the tethers can be bent within the body so that different portions of the same tether are directed in different directions. For example, FIG. 1 shows a portion 18*a* of tether 18 directed in a direction substantially parallel to a longitudinal axis of the body and a portion 18*b* directed in a direction substantially perpendicular to the longitudinal axis of the body. The approximately 90 degree bend allows the tether to be longer than it could be if it were primarily arranged only perpendicular to the longitudinal axis of the toy. In general, increased tether extension can be accomplished by aligning a slide mechanism close to a longer axis of the toy, and then bending the individual tethers to exit the body at desired locations with desired trajectories. A tether may be bent virtually any other amount to achieve a desired tether extension at a desired location. In yet another example, a tether and/or slide assembly can include multiple bends or folds (180 degree bends), thus allowing the length of a tether to be longer than any dimension of the toy. Similarly, a tether can be coiled, similar to a tape measure, so as to be relatively long while occupying little space within the body.

The tethers may be made from at least partially resilient materials such as plastic and/or rubber. The resiliency of the tethers can allow them to bend and/or turn within the body to achieve longer extensions. Furthermore, the resiliency can allow the tethered pieces to oscillate or vibrate once extended. In some embodiments, the tethers may be pre-twisted, so that the tethered pieces appear to spin as they extend away from a body. The tethers can additionally or alternatively include a shaped surface that promotes jitteriness as the pieces extend. In some embodiments, some tethers may have a different twist or surface shaping than other tethers. At least some of the tethers can be constructed of sufficiently strong materials and extended away from the toy at a sufficiently high trajectory so that the tethered piece is suspended off of the ground when fully extended.

The individual tethers can be constructed differently than one another. For example, the individual tethers can have different lengths, can be bent in different directions, can be bent by different amounts, can have different twists, and/or can have different resiliencies and/or stiffnesses.

As shown in dashed lines in FIGS. 1-3, each of the plurality of tethers can be attached to a slide 22. Slide 22 is movable along a track 24. Because the tethered pieces are attached to the slide, the tethered pieces move with the slide and can extend away from the body when the slide moves on the track (FIG. 2).

FIG. 2A schematically shows an exemplary configuration of a slide, tethers coupled to the slide, and a track. A plurality of tethers 18 are connected to the same slide 22. Slide 22 is movable along track 24. A ramp 21 is also shown, the ramp being configured to change the direction of the tether. The ramp can have a slot that allows a spring to pass through, and the spring can be connected to the slide to bias the slide into an extended state.

It should be noted that the tethers and track may have various configurations, and/or a different mechanism can be used for extending the tethers. For example, two or more tracks may be used. Thus, some of the tethered pieces may be extended by one slide while others are extended by a different slide. When two or more slides, or other extension mechanisms, are present, they can be configured to extend responsive to the same triggering event, or responsive to a different triggering event. Further, the illustrated slide and track mechanism is provided as a nonlimiting example for extending the plurality of tethers, and other extension mechanisms can be used.

Figure 4A:
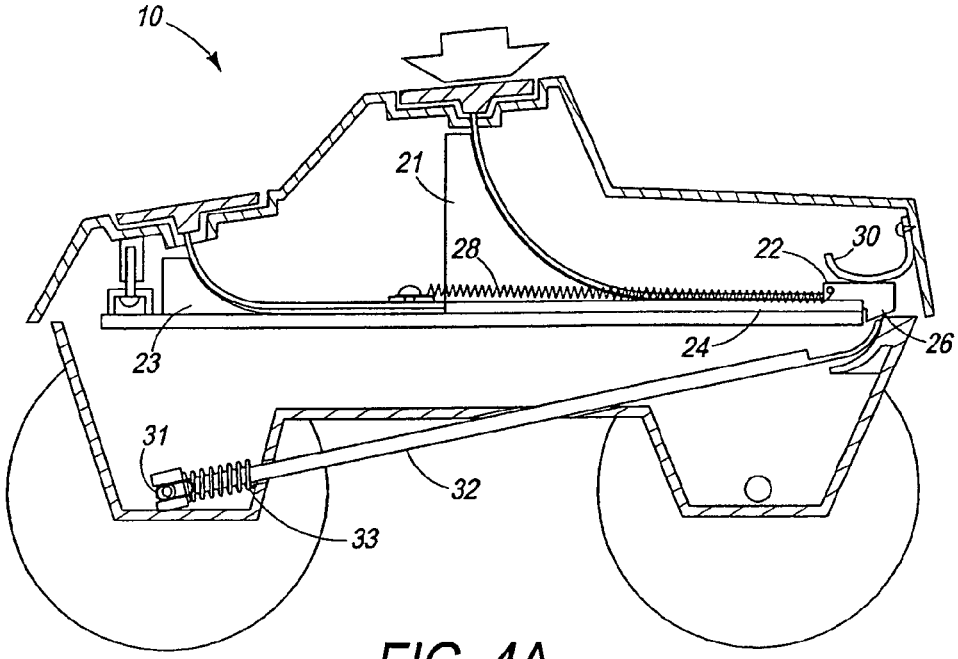
FIGS. 4A and 4B schematically show an exemplary triggering mechanism for moving the tethered pieces from a retracted state to an extended state.
Figure 4B:
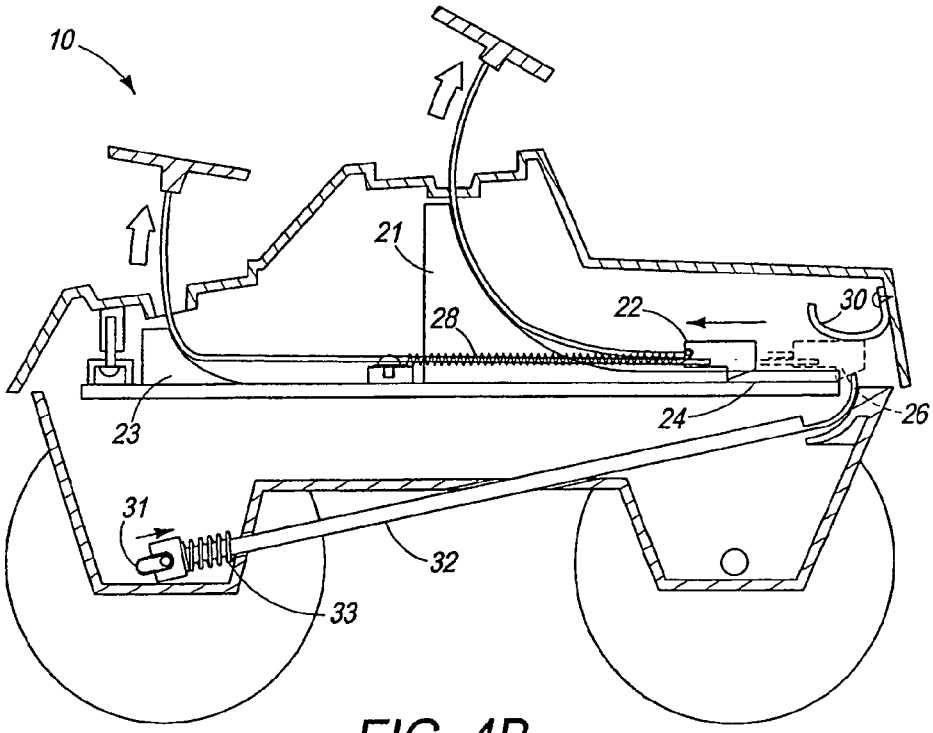

FIGS. 4A and 4B schematically illustrate a triggering mechanism that sets the tethered pieces into motion from a retracted state to an extended state. In the illustrated embodiment, an extended state can be triggered when the front wheels hit an obstacle (i.e., a front wheel collision is the triggering event).

As explained above, each of the plurality of tethers can be connected to slide 22. The plurality of tethers can initially be guided in a relatively straight path corresponding to track 24. The direction of a tether can then be changed by a guide, such as ramps 21 and 23. The slide can be biased in a forward direction (corresponding to an extended tether) by spring 28. However, a catch 26 on the slide can prevent the slide from moving forward and extending the tethered pieces. The catch can engage any suitable reference structure, such as a portion of the track, or another portion of the toy body. A spring 30 may apply a force to help maintain the catch in the retracted state.

FIG. 4B shows the tethered pieces moving into the extended state. In order to trigger an extended state, catch 26 can be released by lifting the catch so that the slide no longer can resist the biasing of spring 28. In the illustrated example, the catch is released by a triggering bar 32, which translates an upward and backward movement of the front wheels to the catch, thereby releasing the catch and allowing the slide to move forward.

The front axle extends through a groove 31 that angles backward and upward. However, triggering bar 32 engages the axle and a spring 33 biases the axle to its forward and downward position (FIG. 4A). When the axle is forward and downward, the triggering bar is poised to lift catch 26, but spring 33 keeps the triggering bar from moving upward and backward to lift the catch. However, if the front wheels experience a sufficient force, the biasing applied by spring 33 can be overcome, and the axle may move upward and backward in slot 31. The triggering bar can then translate this motion to the slide, and lift catch 26 (FIG. 4B). At this time, the tethered pieces can be extended as spring 28 pulls the slide forward.

Figure 7:
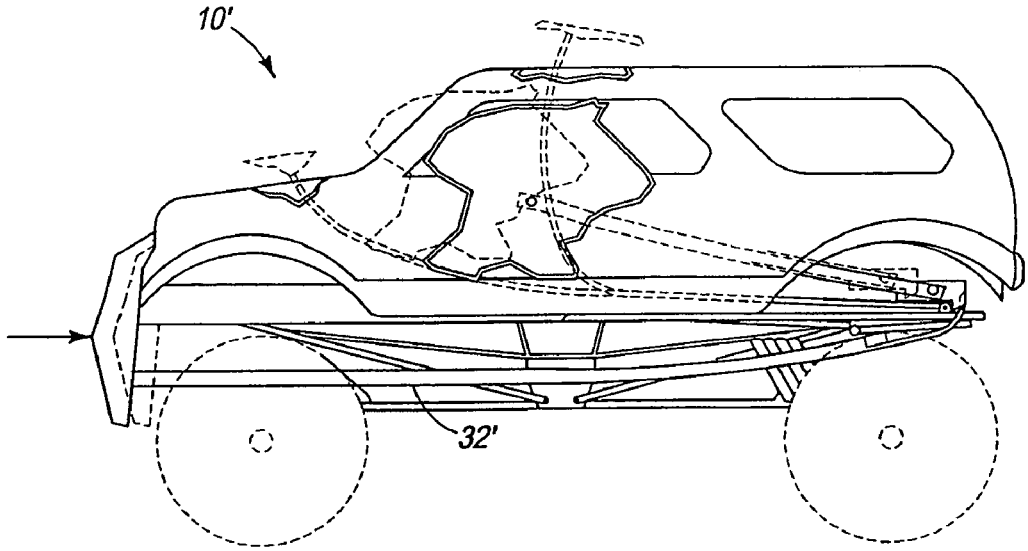
FIG. 7 shows an alternative toy vehicle having a different body style and a different triggering mechanism.

It should be noted that the above described triggering mechanism is a nonlimiting example, and the extended state can be triggered by various other mechanisms. For example, a trigger bar may be movably coupled with a bumper instead of a front-wheel axle. As a nonlimiting example, FIG. 7 shows a toy 10' that includes a triggering bar 32' that extends from the bumper, instead of the front axle, to the catch holding the slide in a retracted state.

The tethered pieces can be returned to a retracted state from an extended state by pushing one of the tethered pieces back towards the body, as demonstrated in FIG. 4A. As the tethered piece is pushed back, the tether to which it is attached can be forced back into the body, thus causing the slide to move backward on the track. As the slide moves backward, the other tethers attached to the slide move the other tethered pieces back toward the body. When the slide is pushed back far enough, catch 26 can engage, setting the toy for a subsequent triggering. Other reset mechanisms can be used. For example, a pull cord could be attached to the slide and could be used to pull the slide backward, thus simultaneously moving all tethered pieces from an extended state to a retracted state. In some embodiments, the slide can be operatively coupled to a motor designed to move the slide back to its retracted state.

Figure 4C:
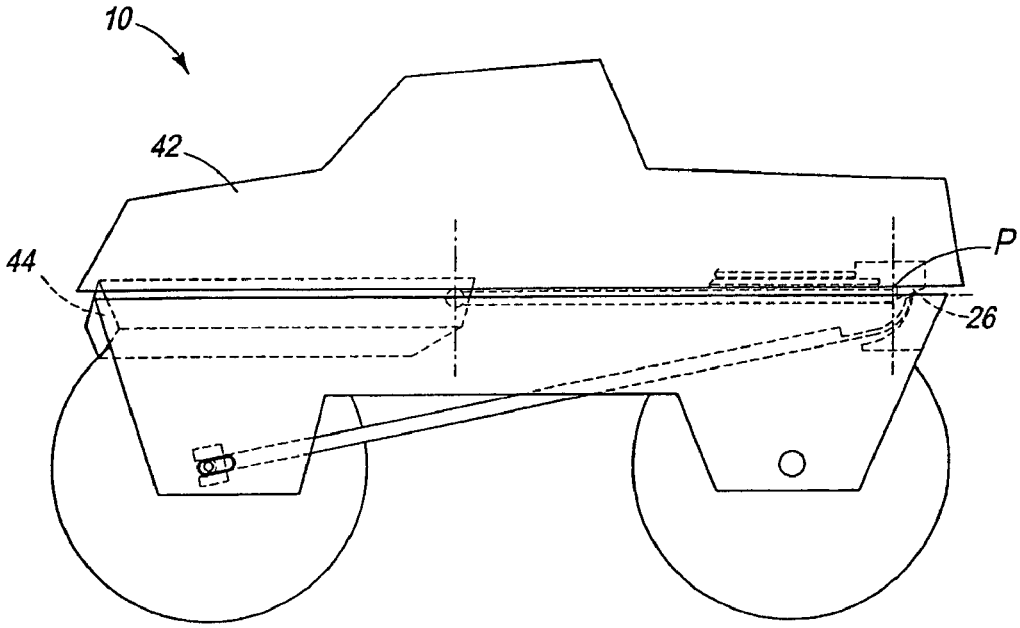
FIGS. 4C and 4D schematically show how the triggering mechanism of FIGS. 4A and 4B can be configured to avoid accidental triggering when the toy is moved into an open-mouth configuration.
Figure 4D:
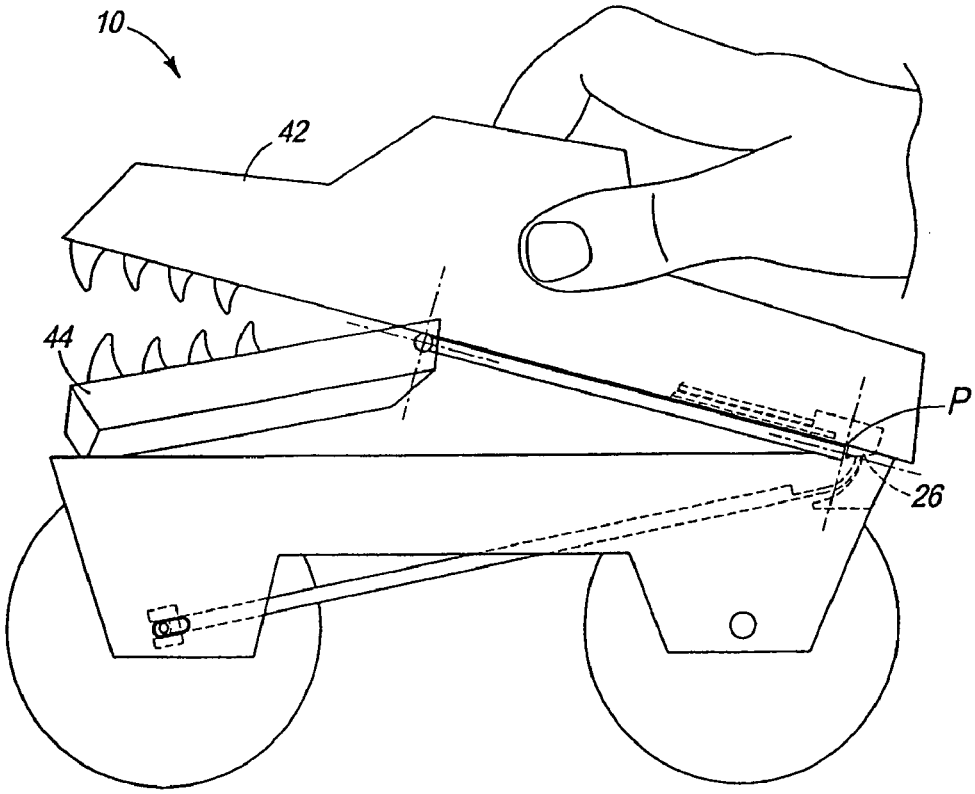

As demonstrated in FIGS. 4C and 4D, some embodiments can include a mouth that can be opened by lifting an upper body portion and allowing a lower jaw portion to drop. In such embodiments, catch 26 can be aligned with a pivot point P about which the upper body portion is lifted. In this manner, lifting the upper body portion does not move the catch, accidentally triggering the slide to move the tethered pieces into the extended state. At the same time, the catch does not move out of the range of the triggering bar, and if a triggering event occurs, the tethers can be moved to an extended state, even when the body is lifted and the mouth is open.

As shown in FIG. 3, a toy vehicle can optionally include a mouth that can selectively open. For example, an upper body portion of the vehicle can be lifted, allowing a lower jaw portion to drop, thus simulating the appearance of a monster opening its mouth. When the upper body portion is lowered, the mouth closes. This can produce a dramatic effect that is interesting to children. It can also facilitate using such toys in simulated battle contests, in which the toys are used to attack one another. Furthermore, when used in combination with the tethering pieces, a seemingly normal vehicle can suddenly be transformed into a very different type of toy. In particular, the tethered pieces may extend to reveal beast-like features underneath, and the mouth may open to further establish a beast-like motif. Of course, other types of transformations could alternatively be brought about, and a truck-to-beast transformation is provided as a nonlimiting example.

Figure 5A:
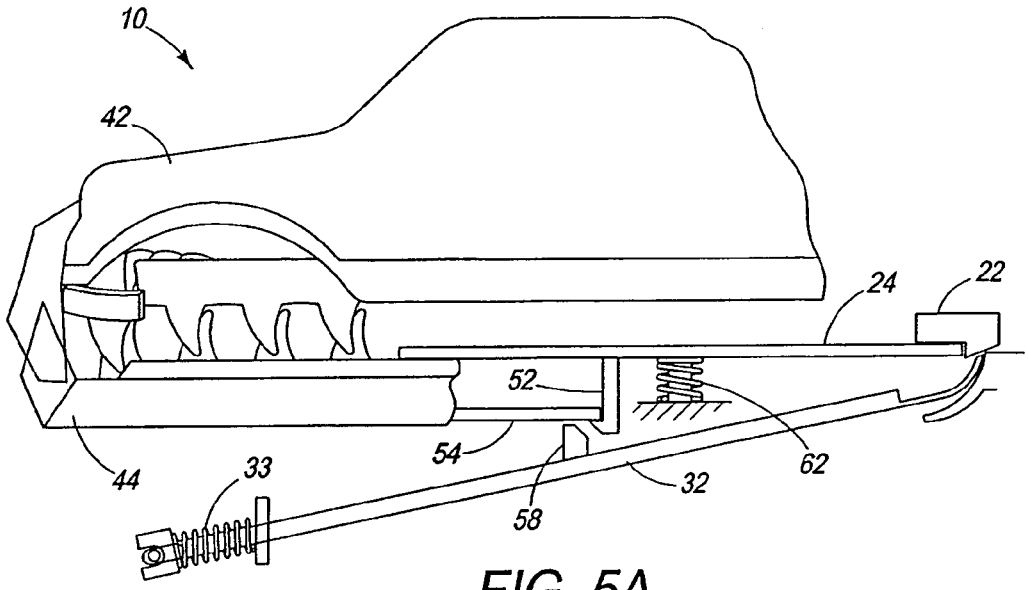
FIGS. 5A, 5B, and 5C schematically show an exemplary triggering mechanism for moving the toy into an open-mouth configuration.
Figure 5B:
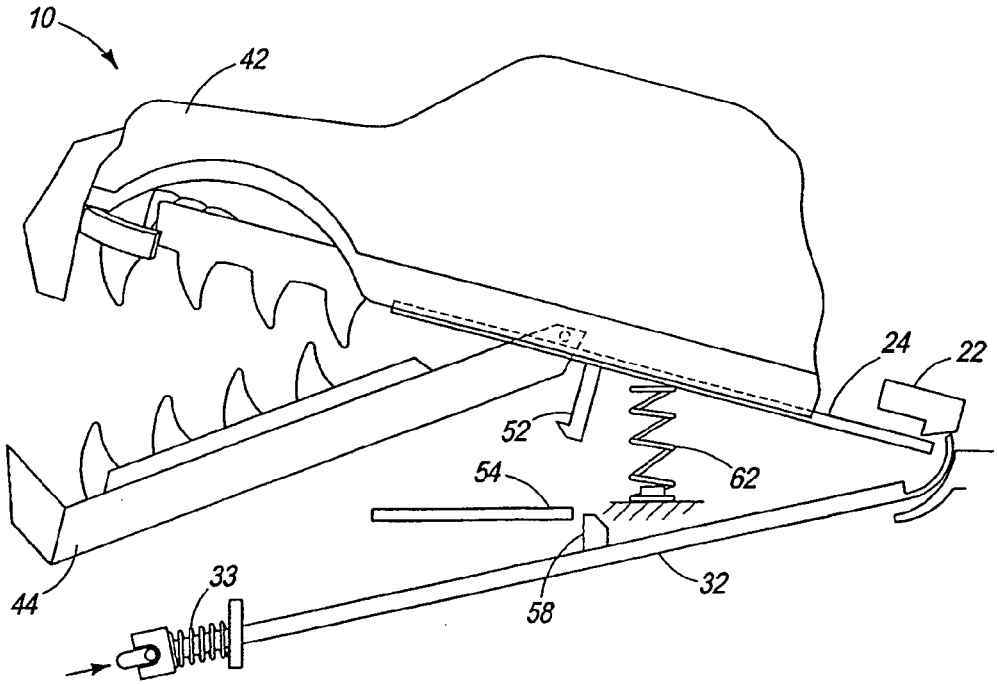

FIGS. 5A and 5B schematically show toy 10 transforming into an open-mouth configuration, in which an upper body 42 lifts up and a lower jaw 44 drops away from the upper body. Upper body 42 may be lifted by a hand as shown in FIG. 4D, or the upper body can be automatically lifted by a spring 62. A triggering mechanism can be used to coordinate the automatic opening of the mouth with a predetermined triggering event. In the illustrated embodiment, the triggering mechanism is actuated by a force applied to the front wheels, although this is not required. In other words, the same triggering event can cause the mouth to open and cause the tethered pieces to expand, as explained above.

FIG. 5A shows the triggering mechanism in a latched configuration in which a latch arm 52 secures upper body 42 to a non-moving portion, or catch, 54 of the toy. The latch arm holds the upper body portion down when it engages catch 54. A trigger bar 32 extends from the front axle to near where latch arm 52 engages catch 54. The trigger bar includes a protrusion 58 that is designed to disrupt the engagement of latch arm 52 to catch 54 when the trigger bar moves responsive to a force applied to the front wheels. In particular, the latch arm 52 and the protrusion are complementarily configured so that the protrusion disengages the latch arm from the catch, as shown in FIG. 5B.

Spring 62 can lift upper body 42 when the latch arm becomes disengaged from the catch. As a result, lower jaw 44 can drop open as the upper body lifts up. As described above, the same triggering mechanism also can cause the tethered pieces to become extended, as shown in FIG. 3.

Figure 5C:
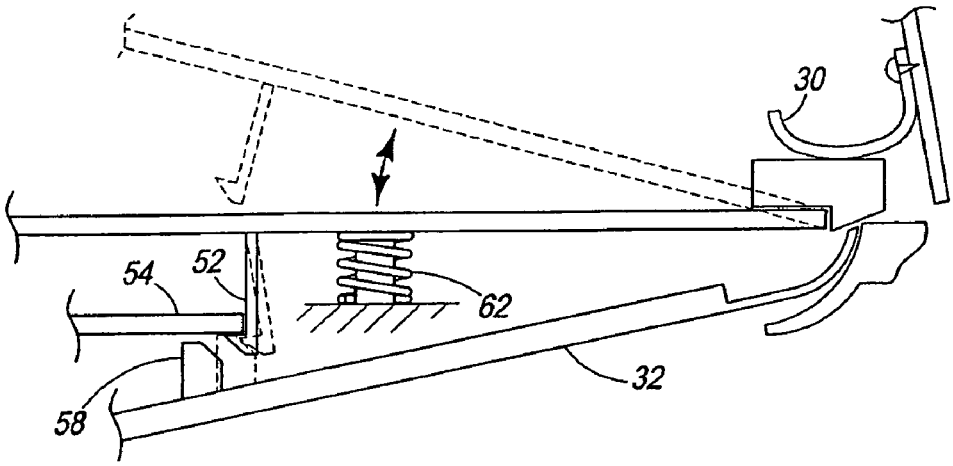

After the tethering mechanism and the mouth-opening mechanism have been triggered, one or both of the mechanisms can be reset. For example, only the mouth-opening mechanism can be reset. This can be accomplished by pushing down on upper body 42 until latch arm 52 securely engages catch 54. As described above, the tethering mechanism can be reset by pushing down on one of the tethered pieces. The tethering mechanism can be reset alone, or the tethering mechanism can be reset in combination with the mouth-opening mechanism. If only the tethering mechanism is reset, the mouth can be manually opened by a user, as shown in FIG. 4D. FIG. 5C schematically shows how the tethering mechanism can remain set and ready for triggering while the upper body is manually moved up and down.

Figure 6:
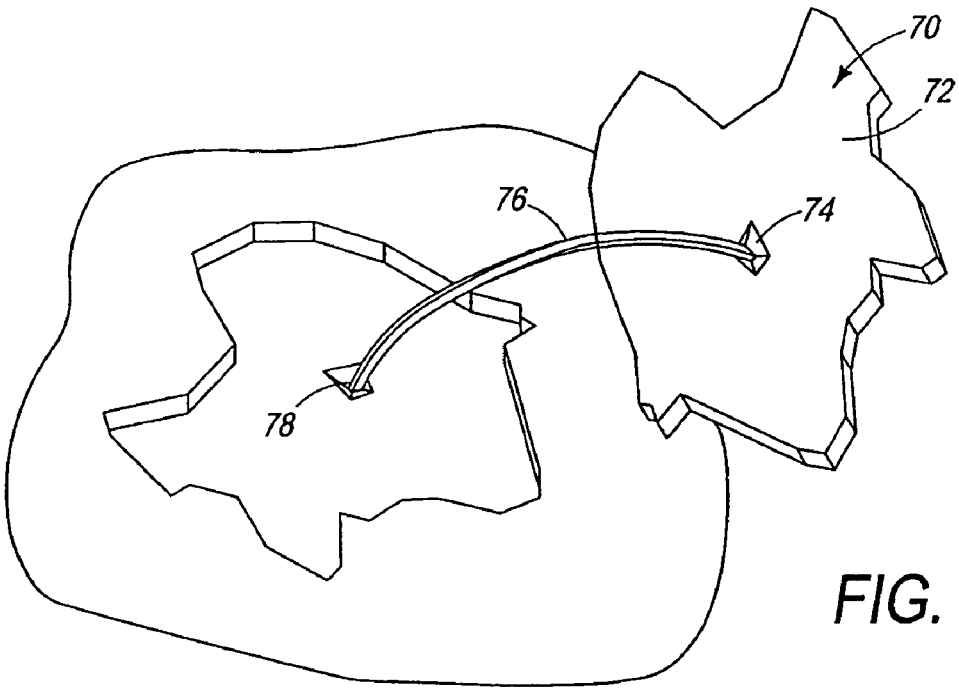
FIG. 6 shows an exemplary tethered piece keyed for alignment with a corresponding body portion.

FIG. 6 shows an exemplary configuration illustrating the alignment between a tethered piece and a portion of a toy. As shown in FIG. 6, a tethered piece 70 includes a panel 72, a key portion 74, and a tether 76 connected to the key portion 74. The key portion has the largest cross sectional area near panel 72. The cross sectional area of the key portion decreases near tether 76. In other words, the key portion has a sloped surface relative to panel 72. Body 12 includes an opening 78 that is complementary to the shape of key portion 74.

The above configuration can facilitate the alignment between the tethered piece and the body. For example, the smaller part of key portion 74 is moved into the larger part of opening 78. In this way, there is increased positional tolerances during initial engagement between the key portion and the opening. As the key portion is further inserted into the opening, the positional tolerances decrease, and the tethered piece is accurately guided into a desired position. The angled surfaces of the opening and the keyed portion limit the tethered piece from snagging on the opening, which could prevent the tethered piece from being fully seated, and as a result, could prevent the tethering mechanism from being fully reset.

FIG. 6 also shows that a tethered piece may be made with a thickness that corresponds to the thickness of the area vacated by the tethered piece. In this way, the tethered piece can be substantially flush with an outer surface of the toy when the tethered piece is in a retracted state.

Figure 8:
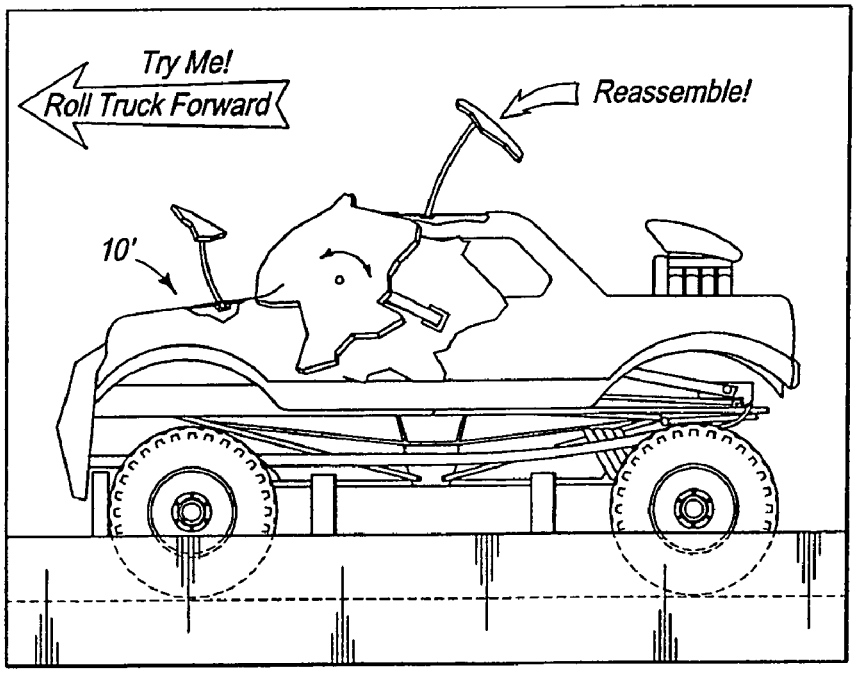
FIG. 8 shows the toy of FIG. 1 in exemplary packaging that facilitates demonstration of the extension and retraction of the tethered pieces.

FIG. 8 shows toy 10' in packaging that allows the tethering mechanism to be demonstrated while the toy remains packaged. The ability of the tethering mechanism to reset by pushing down on one of the tethered pieces allows the extended state to be repeatedly triggered while the toy remains in the packaging. In embodiments that include an open-mouth configuration, the automatic mouth-opening can also be triggered and reset.

The various dynamic transformations described above can be coordinated with lights and sounds produced by toy 10. For example, the toy chassis may include a battery operated sound system that plays prerecorded growling, barking, and roaring noises when the mouth-opening and/or tethering is triggered. Similarly, the chassis may include lights, such as head light that glow a different color when a transformation is triggered. Virtually any number of different sounds or visual effects can be used to make toy transformations even more exciting.

It will be appreciated that the configurations disclosed herein are exemplary in nature, and that these specific embodiments are not to be considered in a limiting sense, because numerous variations are possible. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A toy, comprising:

a body, the body resembling a toy vehicle;

a plurality of tethers moveably coupled to the body;

a corresponding plurality of tethered pieces coupled to the plurality of tethers and moveable between a retracted state in which the plurality of tethers hold the tethered pieces proximate the body and an extended state in which the plurality of tethers hold the tethered pieces away from the body, at least one of the tethers facilitating oscillation of its tethered piece after its tethered piece moves from its retracted state to its extended state;

a triggering mechanism operatively coupled to the plurality of tethers and adapted to move the plurality of tethered pieces from the retracted state to the extended state responsive to a triggering event;

a first guide directing at least one of the tethers in a first direction; and a second guide directing the at least one tether in a second direction, different than the first direction.

2. The toy of claim 1, wherein the first guide includes a slide operatively coupled to the plurality of tethers and movable along a track in the first direction, wherein the triggering event initiates movement of the plurality of tethers from the retracted state to the extended state.

3. The toy of claim 2, wherein the slide is biased toward the extended state and the triggering mechanism holds the slide in the retracted state against the bias prior to the triggering event.

4. The toy of claim 1, wherein the first direction is substantially parallel to a longitudinal axis of the toy.

5. The toy of claim 4, wherein the second direction is substantially perpendicular to a longitudinal axis of the toy.

6. The toy of claim 1, wherein the first direction is at least 45 degrees different than the second direction.

7. The toy of claim 1, further comprising a plurality of wheels rotatably coupled to the body.

8. The toy of claim 7, wherein at least one of the plurality of wheels is part of the triggering mechanism.

9. The toy of claim 1, wherein the body includes a top mouth portion movably coupled to a bottom mouth portion via a jaw joint.

10. The toy of claim 9, wherein the triggering mechanism is adapted to move the top mouth portion relative to the bottom mouth portion responsive to the triggering event.

11. The toy of claim 1, wherein at least some of the tethered pieces fit substantially flush with a surface of the body.

12. The toy of claim 1, wherein each tethered piece includes a panel portion and a key portion, wherein the tether is connected to the key portion, and wherein the key portion is shaped to facilitate alignment of the tethered piece with the body when moved from the extended state to the retracted state.

13. The toy of claim 12, wherein a cross sectional area of the key portion increases from the tether to the panel portion, and the body includes a hole complementarily shaped relative to the key portion.

14. The toy of claim 1 wherein the triggering mechanism is adapted to move at least two of the tethered pieces from the extended state to the retracted state responsive to a force applied to one of the plurality of tethered pieces.

15. A toy, comprising:

a body, the body resembling a toy vehicle;

a plurality of tethers moveably coupled to the body;

a corresponding plurality of tethered pieces coupled to the plurality of tethers and moveable between a retracted state in which the plurality of tethers hold the tethered pieces proximate the body and an extended state in which the plurality of tethers hold the tethered pieces away from the body; and a triggering mechanism operatively coupled to the plurality of tethers and adapted to move the plurality of tethered pieces from the retracted state to the extended state responsive to a triggering event;

wherein the triggering mechanism is adapted to move at least two of the tethered pieces from the extended state to the retracted state responsive to a force applied to one of the plurality of tethered pieces.

16. The toy of claim 15, wherein the one of the plurality of tethered pieces is located at a top of the vehicle.

17. The toy of claim 15, wherein the tether coupled to the one of the plurality of tethered pieces bends at least 45 degrees within the body.

18. A toy, comprising:

a body, the body resembling a toy vehicle;

a plurality of tethers moveably coupled to the body;

a corresponding plurality of tethered pieces coupled to the plurality of tethers, wherein at least some of the tethered pieces include a panel portion and a key portion, wherein at least one tether is connected to a key portion, and wherein the key portion is shaped to facilitate alignment of the tethered piece with the body when moved from an extended state in which the tethered piece is spaced apart from the body to a retracted state; and a triggering mechanism operatively coupled to the plurality of tethers and adapted to move the plurality of tethered pieces from a retracted state to an extended state responsive to a triggering event.

19. The toy of claim 18, wherein a cross sectional area of the key portion increases from the tether to the panel portion, and the body includes a hole complementarily shaped relative to the key portion.

20. The toy of claim 18, wherein at least one tether facilitates oscillation of its tethered piece after its tethered piece moves from its retracted state to its extended state.

21. A toy, comprising:

a body, the body having an outer surface and a plurality of wheels coupled thereto;

a movable part, the movable part being movable relative to the body, the movable part being disposable in a retracted state in which the movable part forms part of the surface of the body, and the movable part being disposable in an extended state in which the movable part is spaced apart from the body;

a tether, the tether being coupled to the movable part and configured to couple the movable part to the body, the tether facilitating oscillation of the movable part after the movable part moves from the retracted state to the extended state; and a triggering mechanism, the triggering mechanism being configured to move the tether from a first position to a second position in response to a triggering event, the movable part being disposed in its retracted state when the tether is in the first position, and the movable part being disposed in its extended state when the tether is in the second position.

22. The toy of claim 21, wherein the movable part is substantially flush with the surface of the body when the movable part is in the retracted state.

23. The toy of claim 21, further comprising:

a guide, the guide being coupled to the body, the guide being configured to direct the tether in a particular direction relative to the body.

24. The toy of claim 21, wherein the tether extends from the body in its second position and the tether is disposed within the body in its first position.

25. The toy of claim 21, wherein the triggering mechanism includes a slide, the slide being coupled to the tether, the slide being movable between its own first position and its own second position, the slide being biased from its first position to its second position by a biasing member, the tether being configured to slide relative to the body as the slide moves between its first position and its second position.

* * * * *